United States Patent [19]

Ogawa et al.

[11] Patent Number: 4,801,282

[45] Date of Patent: Jan. 31, 1989

[54] REMOTE CONTROL APPARATUS

[75] Inventors: Toshimitsu Ogawa; Shinichi Kudo, both of Tokyo, Japan

[73] Assignees: Nissan Motor Co., Ltd., Yokohama; Tohatsu Corporation, Tokyo, both of Japan

[21] Appl. No.: 16,919

[22] Filed: Feb. 20, 1987

[30] Foreign Application Priority Data

Feb. 21, 1986 [JP] Japan ..... 61-24259[U]

[51] Int. Cl.[4] ..... B63H 21/28

[52] U.S. Cl. ..... 440/84; 440/86; 440/87; 74/480 B

[58] Field of Search ..... 440/53, 61, 75, 84, 440/86, 87; 74/480 B, 483 R, 483 PB

[56] References Cited

U.S. PATENT DOCUMENTS 2,867,132 1/1959 Schroeder ..... 440/87

4,119,186 10/1978 Choudhury et al. ..... 74/480 B 4,310,320 1/1982 Pitchford ..... 446/61

4,637,802 1/1987 Taguchi et al. ..... 440/86

OTHER PUBLICATIONS

Kazi (Rudder), Feb., 1984, p. 122.

*Primary Examiner*—Sherman D. Basinger

*Assistant Examiner*—Stephen P. Avila

*Attorney, Agent, or Firm*—Foley & Lardner, Schwartz, Jeffery, Schwaab, Mack, Blumenthal & Evans

[57] ABSTRACT

An apparatus for controlling a plurality of driving units comprises a lever device pivotable to operate each driving unit, and a switch device having a plurality of switches each for changing the position of a driving portion of each driving unit. The switch device is disposed in the lever device such that the lever device and thed plurality of switches are simultaneously manually operated.

6 Claims, 8 Drawing Sheets

REMOTE CONTROL APPARATUS

BACKGROUND OF THE INVENTION

Field of the Invention

The present invention relates to a remote control apparatus which is used for a marine propulsion system such as outboard engine type in which engine, propeller shaft, and propeller are provided as a united body.

Description of the Prior Art

Heretofore, as remote control apparatus for a marine propulsion system, there have been known, for example, those shown in Photo No. 10 and Photo No. 12 on p. 122 of February, 1984 issue of "KAZI(Rudder)", published by Kazi Co., Ltd.

The prior-art remote control apparatus comprises, as shown in FIG. 1, a control box 100, a control lever 101, a lever grip 102, a lock button 103 a tilt and trim switch 104, a free accelerator lever 105, a main switch 106, a wire harness 107, a control cable 108, and others that are mounted on a ship's body 109 near an operator's seat.

The control lever 101 is a lever for carrying out clutch operation and throttle operation, with the lever position shown in FIG. 1 as neutral position. By turning the lever forward, the ship can be moved forward and by turning the lever backward it can be moved backward.

In addition, the tilt and trim switch 104 is a switch for carrying out tilt angle displacement which turns the propeller of a marine propulsion system in the up and down direction from the normal position below the ship's bottom to a position which is above the ship's bottom or vice versa, and for carrying out trim angle adjustment which gives a fine adjustment to the direction of the propulsive power by turning the propeller of the marine propulsion system in the up and down direction in an underwater position. This switch is provided in the lever grip 102 of the control lever 101.

Such a prior-art remote control apparatus works well as long as there is one remote control apparatus for one unit of marine propulsion system. However, when there are a plurality of marine propulsion systems, there are problems that will be described next.

(A) First, when two units of the prior-art remote control apparatus are mounted side by side on ship's body 109 via a spacer 110, tilt and trim switches 104L and 104R will have to be positioned outside lever grips 102L and 102R, namely at the positions that are fartherst apart from each other. Then, with a hand which is operating the control levers 101L and 101R, it is possible to operate one of the tilt and trim switches 104L and 104R. However, there is a problem that the switch controllability is unsatisfactory because it is not possible to operate both of the tilt and trim switches 104L and 104R simultaneously.

(B) Further, when a plurality of remote control apparatuses are used, both the tilt and trims swicthes are sometimes detached from the respective grip sections and are separately attached side by side to the ship's body near the operator's seat. In such a case, it becomes possible to control both the tilt and trim switches simultaneously. However, it is not possible to control the switches using the same hand which is controlling the control levers, so that there is a problem that the level control and the switch control have to be carried out separately. In addition, by installation of the tilt and trim switches at separate positions, there is a problem that it leads to a rise in cost due to labor for installation and an increase in the number of parts.

Further, when a plurality of marine propulsion systems are used, it is possible to reduce the number of tilt and trim switches to only one. However, for example, when the ship's body is tilted on a shoal due to cargo, it becomes necessary to pull up one of the propellers, and the tilt angle displacement mechanism or the trim angle adjustment mechanism cannot be accomplished with only one switch, so that it is desirable to provide one switch for each of the marine propulsion system.

SUMMARY OF THE INVENTION

To solve the above problems, according to the present invention, an apparatus for controlling a plurality of driving units comprises lever means pivotable to operate each driving unit, and switch means having a plurality of switches each for changing the position of a driving portion of each driving unit, said switch means being disposed in said lever means such that the lever means and said plurality of switches are simultaneously manually operated.

DETAILED DESCRIPTION OF THE PREFERRED EMBODIMENTS

The preferable embodiments of the present invention will be described in detail by referring to the figures. In describing the embodiments, a remote control apparatus for a ship equipped with an outboard engine as a marine propulsion system will be taken as an example.

First, the construction of the apparatus in accordance with a first embodiment of the present invention will be described.

Figure 1:
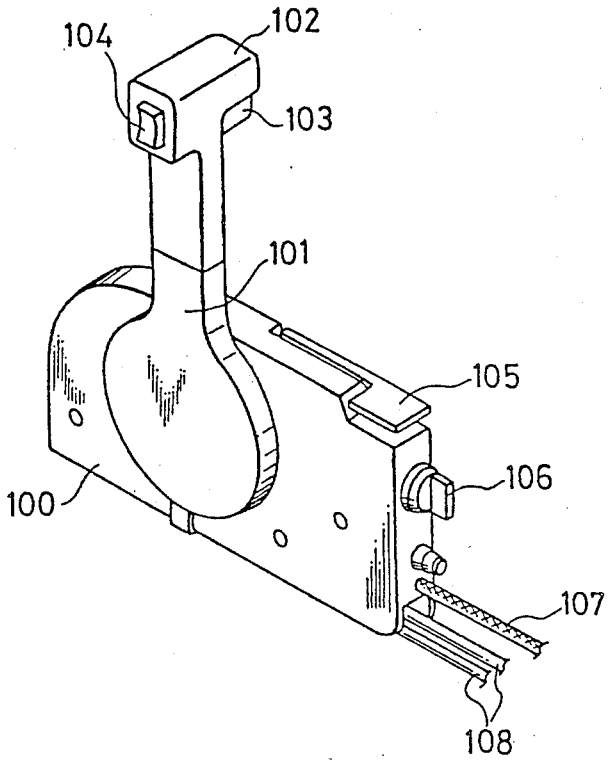
FIG. 1 PRIOR ART
FIG. 1 is a perspective view which shows a remote control apparatus for one prior-art marine propulsion system.
Figure 2:
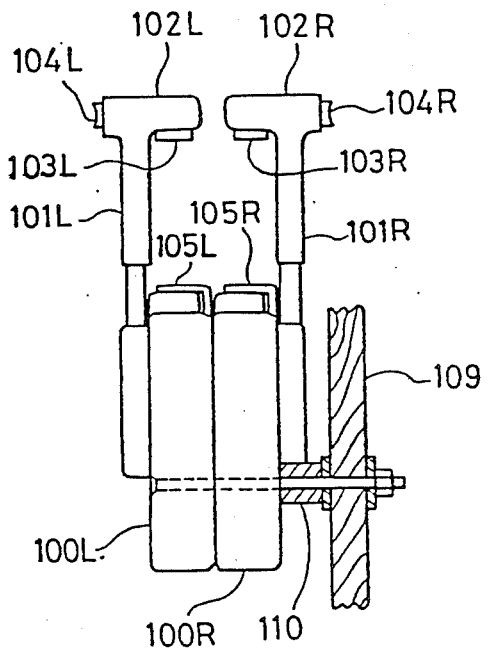
FIG. 2 PRIOR ART
FIG. 2 is a side view of a remote control apparatus for two prior-art marine propulsion systems.
Figure 3:
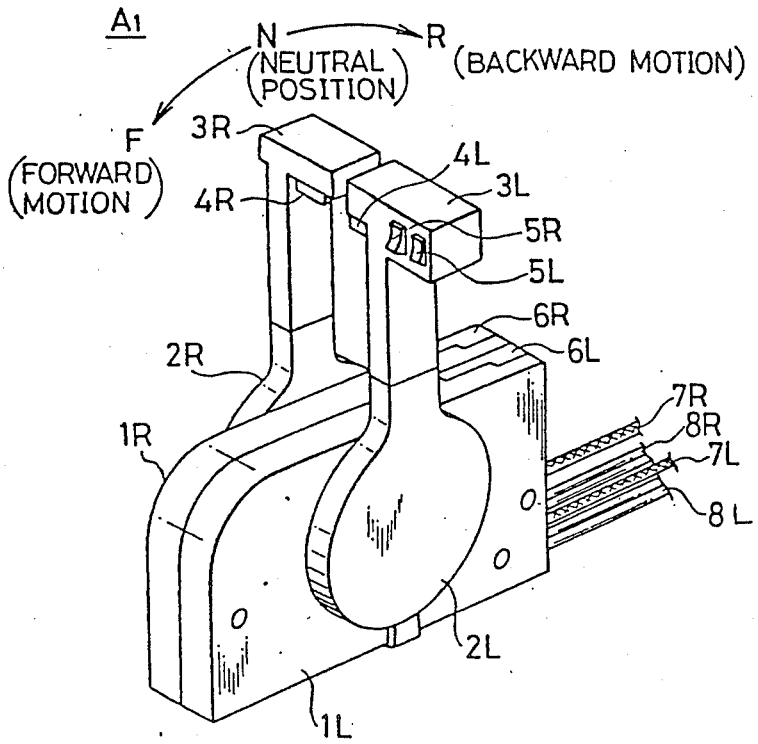
FIG. 3 is a perspective view for showing a first embodiment of a remote control apparatus of the present invention.

As shown in FIG. 3, a remote control apparatus A1 for an outboard engine is equipped with control boxes 1L and 1R, control levers 2L and 2R, lever grips 3L and 3R, lock buttong 4L and 4R, tilt and trim switches (propeller position adjustment switches) 5L and 5R, free accelerator levers 6L and 6R, wire harnesses 7L and 7R, and control cables 8L and 8R.

Figure 4:
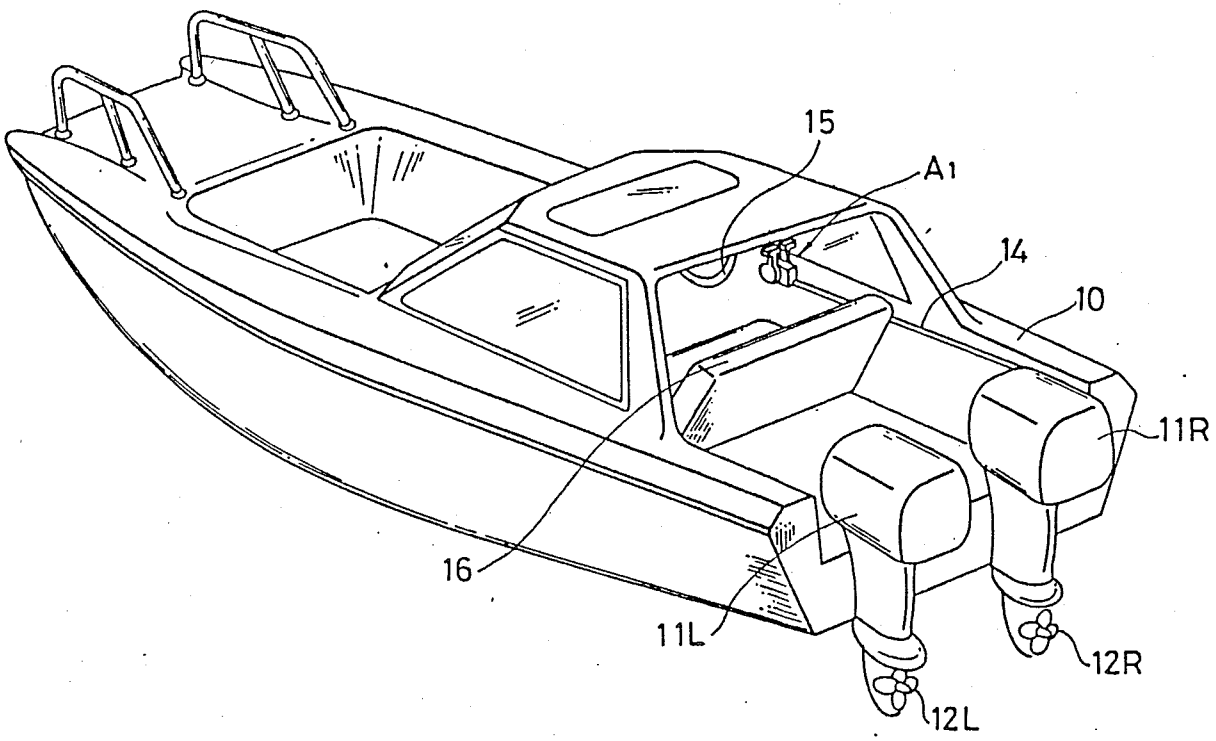
FIG. 4 is a perspective view which shows a ship equipped with the remote control apparatus in the first embodiment.

The control boxes 1L and 1R are mounted on a side of an operator's seat in a ship's body 10 with the boxes placed side by side, as shown in FIG. 4. On the control boxes 1L and 1R, there are provided the control levers 2L and 2R, the free accelerator levers 6L and 6R, and a main switch, a chalk switch, and others that are not shown.

The control levers 2L and 2R are means for carrying out the clutch control and the throttle control of outboard engines 11L and 11R. The control levers 2L and 2R in FIG. 3 are in a neutral position, and when they are turned in the forward direction from the neutral position by a predetermined angle, the clutch is engaged, and thereafter the throttle is opened in proportion to the angle turned forward. In addition, when the levers are turned backward from the neutral position by a predetermined angle, the clutch is engaged, and thereafter the opening of the throttle is changed in proportion to the angle of the backward turning.

The lever operating forces for the control levers 2L and 2R are transmitted to the outboard engines 11L and 11R via the wire harnesses 7L and 7R.

The lever grips 3L and 3R are grips provided above the control levers 2L and 2R. The two lever grips 3L and 3R are arranged in a mutually facing condition, and both lever grips 3L and 3R can be grasped simultaneously with a single hand.

The lock buttons 4L and 4R are buttons provided at inside bottom positions of the lever grips 3L and 3R. By the operation of the lock buttons 4L and 4R, the neutral position holding of the control levers 2L and 2R are released so that the control levers 2L and 2R become turnable forward and backward.

The tilt and trim switches 5L and 5R are switches for carrying out tilt angle displacement and turn the propellers 12L and 12R of the outboard engines 11L and 11R from the normal position lower than the ship's bottom to a position higher than the ship's bottom, or from a position higher than the ship's bottom to the normal position lower than the ship's bottom by the pivotal turning with a pivot P as a center. The switches 5L and 5R carry out trim angle adjustment and finely adjusts the direction of the propulsive power by the pivotal movement around pivot P of the propellers 12L and 12R of the outboard engines 11L and 11R at an underwater position. In the first embodiment, both switches 5L and 5R are provided side by side in the front position of the lever grip 3L on the left hand side (on the side of the operator's seat).

Figure 5:
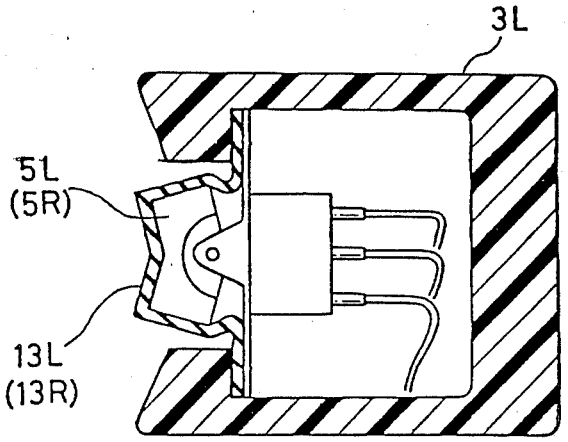
FIG. 5 is a cross sectional view of a tilt and trim switch in the first embodiment.

The tilt and trim switches 5L and 5R are seesaw type switches covered with water-proof covers 13L and 13R as shown in FIG. 5. When the upper side of such switches is pressed, the outboard engines 11L and 11R are turned upward, and when the lower side thereof is pressed, they are turned downward.

Further, lines from the tilt and trim switches 5L and 5R are linked to turning means (such as an oil-pressure cylinder, although not shown) of the outboard engines 11L and 11R via the control cables 8L and 8R.

The free accelerator levers 6L and 6R are levers that open the respective throttle when the levers are turned upward, with the control levers 2L and 2R in the neutral position, and they are used to start the engines or warm gas.

The wire harnesses 7L and 7R are means for transmitting operative forces for the shifting operation and the throttle operation, by the control levers 2L and 2R. Further, the control cables 8L and 8R are cables formed by budling lines for transmitting electrical signals generated by the operation of switches such as the tilt and trim switches 5L and 5R. The control line 14 of these cables are wired along the inside board of the ship's body 10, as shown in FIG. 4.

In addition, a numeral 15 in FIG. 4 is a steering wheel and 16 is a seat.

Next, the operation of the apparatus in the first embodiment will be described.

(A) Tilt Angle Displacement Operation

When the propellers 12L and 12R need be raised to a height above the ship's bottom, for instance, in sailing out of shoals or the like, the lever grips 3L and 3R are grasped with one hand (normally, the right hand) and the upper side of the tilt and trim switches 5L and 5R are pressed with fingers of the same hand. Then, the outboard engines 11L and 11R are turned upward with the pivot P as a center, as shown by the arrow T1 in FIG. 6, raising the propellers 12L and 12R to a position higher than the ship's bottom.

Figure 6:
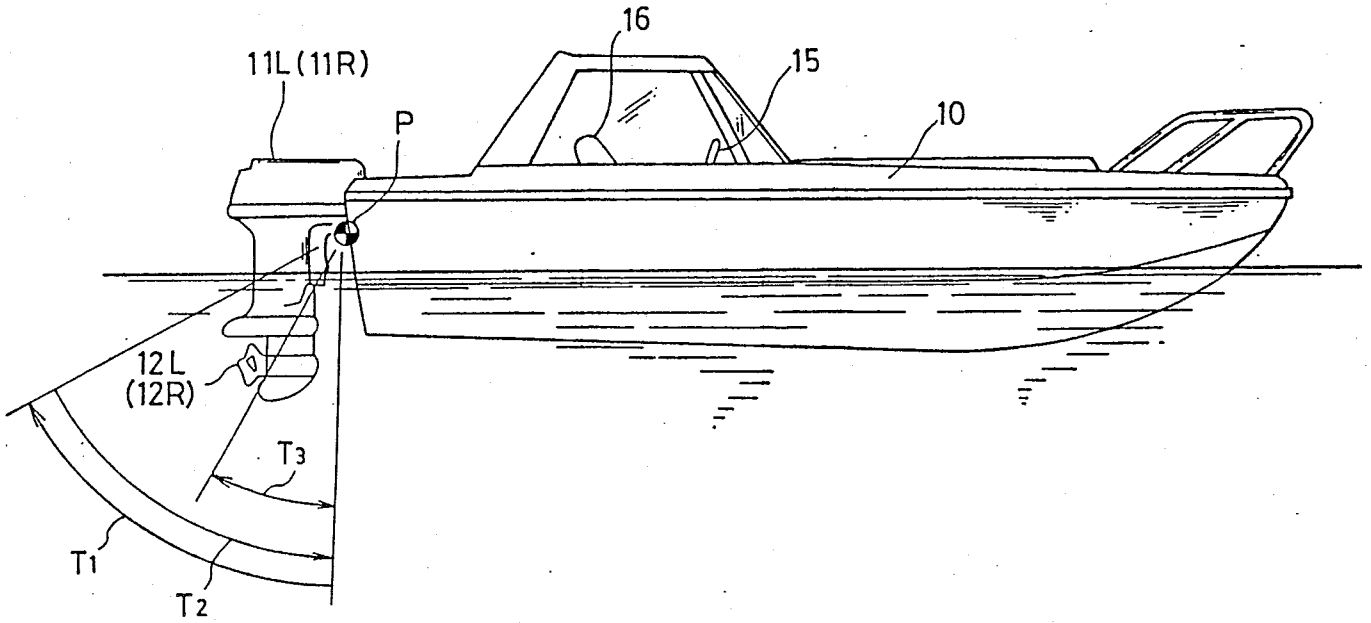
FIG. 6 is a view for explaining a tilt angle displacement control and a trim angle adjustment control in the first embodiment.

When the ship has reached an area having a sufficient water depth where the ship can float, by pressing the lower sides of the tilt and trim switches 5L and 5R, the outboard engines 11L and 11R are turned downward about the pivot P as the center, as shown by the arrow T2 in FIG. 6, and the outboard engines 11L and 11R are lowered to the normal position where they are approximately vertical.

Moreover, when the tilt angle displacement operation is being carried out using the tilt and trim switches 5L and 5R, there is no need for taking the hand off the lever grips 3L and 3R. Therefore, the clutch operation and the throttle operation by the forward or backward turning of the control levers 2L and 2R can be manually carried out simultaneously. In addition, the steering operation by grasping the steering wheel 15 with the other hand that is not grasping the lever grips 3L and 3R (normally, the left hand) can also be carried out.

(B) Trim Angle Adjustment Operation

When the direction of the propulsive power by the propellers 12L and 12R during navigation is adjusted to a direction with maximum propulsive force in response to the weight, inclination, and the like of the ship's body, the outboard engines 11L and 11R are turned upward by pressing the upper sides of the tilt and trim switches 5L and 5R, or the outboard engines 11L and 11R are turned downward by pressing the lower sides of these switches, similar to the above, carrying out the trim angle adjustment within the range shown by angle T3 in FIG. 6.

Moreover, when the adjustment of trim angle is needed for only one of the outboard engines 11L and 11R because of the difference in propulsive power of the left and right outboard engines 11L and 11R due to inclination on one side of the ship's body caused by the an unbalance in weight, it is possible to carry out the trim angle adjustment for only one of the outboard engines 11L and 11R by operating one of the tilt and trim switches 5L and 5R to be adjusted.

As described in the foregoing, in the first embodiment of the remote control apparatus A1 for an outboard engine, the tilt and trim switches 5L and 5R are arranged side by side and centralized in the front position of the left-side lever grip 3L. Therefore, the switch control for the two tilt and trim switches 5L and 5R can be carried out simultaneously using fingers of one hand that carries out the lever operation of the control levers 2L and 2R. With such an arrangement, the switch controllability can be enhanced, and it is advantageous from the cost point of view since the switches are not provided separately.

Next, a second embodiment of the present invention shown in FIG. 7 will be described.

In a remote control apparatus A2, tilt and trim switches 5L and 5R are arranged side by side and centralized on the side surface of the operator's seat of one lever grip 3L.

Figure 7:
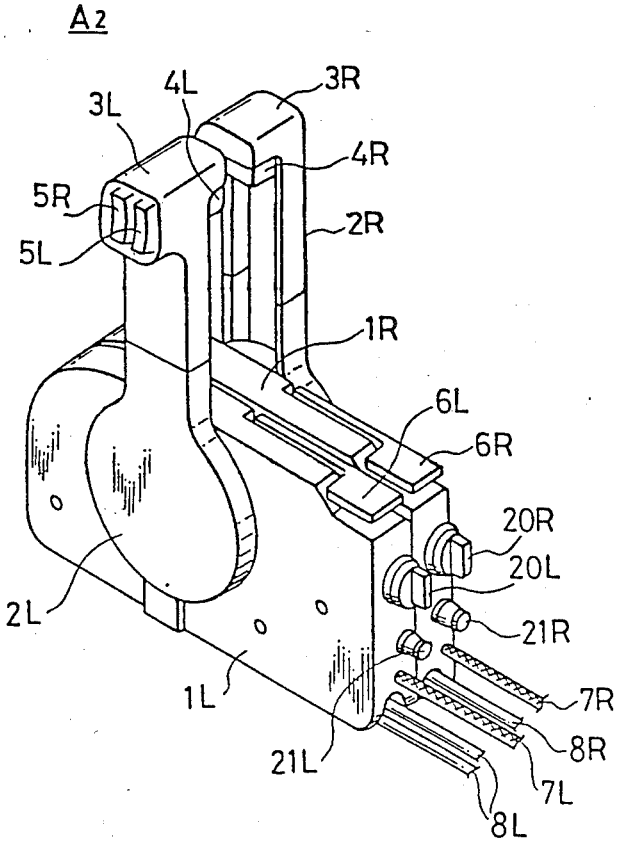
FIG. 7 is a perspective view of a second embodiment of the remote control apparatus.

In FIG. 7, 20L and 20R are main switches, and 21L and 21R are choke switches. Since the other construction is similar to the one of the first embodiment, indentical symbols are used in the figure to omit the further explanation.

Figure 8:
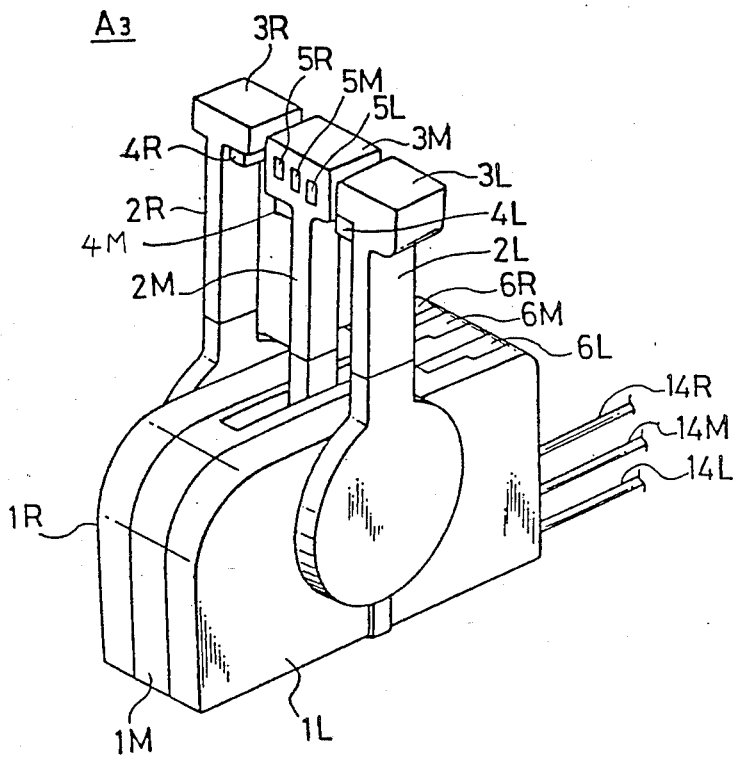
FIG. 8 is a perspective view which shows a third embodiment of the remote control apparatus.

Next, a third embodiment of the present invention shown in FIG. 8 will be described.

In a remote control apparatus A3, there are provided three marine propulsion systems in which three tilt and trim switches 5L, 5M and 5R are respectively arranged side by side and centralized in the front of a control lever grip 3M.

Since the other construction is the same as in the first embodiment, identical symbols are used to omit the further explanation.

In the foregoing, the embodiments of the present invention are described in detail with reference to the fingers. The concrete constructions are not limited to those of the embodiments, and design modification of the like within the scope of the present invention will become possible.

For instance, although the embodiments were described in conjunction with the outboard engine as a marine propulsion system, the present invention can be also applied to an inboard engine where a propeller shaft in the outboard portion is turned in the upward and downward direction Furthermore, although the tilt and trim switch used for both the tilt angle displacement operation and the trim angle adjustment operation is used as a propeller position adjustment switch, the adjustment switch may be a tilt switch which can carry out the tilt angle displacement operation or a trim switch which can carry out the trim angle adjustment operation.

As described in the foregoing, in a remote control apparatus for a marine propulsion system of the present invention, a plurality of propeller position adjustment switches are provided and centralized in a lever grip in one of a plurality of control levers. Therefore, there is obtained an effect that the switch operation for the plurality of propeller position adjustment switches can be simultaneously performed by the use of fingers of one hand while grasping the control lever with the one hand.

What is claimed is:

1. An apparatus for remotely controlling a plurality of marine propulsion units for providing a propelling force for a marine vessel, each propulsion unit having a propeller movable about a horizontal tilt axis which is transverse to the direction of movement of the marine vessel, comprising:

a plurality of control levers, each control lever being operably connected to a respective marine propulsion unit and adapted to control a clutch and a throttle operation of the respective marine propulsion unit; and a plurality of tilt and trim switches disposed in a lever grip of a single control lever and performing at least one of a displacing operation in the tilt angle of the respective propeller around a pivotal point, and an adjusting operation in the trim angle of the respective propeller around the pivotal point to adjust the direction of the propelling force, each switch being operatively connected to a respective marine propulsion unit for controlling movement of the propeller of the propulsion unit about the horizontal tilt axis, whereby an operator of the marine vessel can simultaneously operate the tilt and trim switches and said plural control levers by using a single hand.

2. An apparatus as claimed in claim 1 wherein each control lever comprises locking means for locking the control lever against pivotal movement.

3. An apparatus as claimed in claim 1 wherein each control lever is pivotally mounted for pivoting so as to control the clutch and throttle operation of the respective marine propulsion unit and each control lever comprises said grip in which a respective switch is disposed.

4. An apparatus as claimed in claim 3 wherein each control lever further comprises a locking member for locking the control lever against pivotal movement.

5. An apparatus as claimed in claim 4 wherein each locking member is operable to lock its associated control lever at a neutral position.

6. A remote control apparatus for controlling a plurality of marine propulsion units for providing a propelling force to a marine vessel, each unit having a propeller, said apparatus comprising:

a plurality of control levers respectively disposed corresponding to the marine propulsion units, each of the control levers performing a clutch and a throttle operation of each of the marine propulsion units; and a plurality of tilt and trim switches for performing at least one of a displacing operation in the tilt angle of the respective propeller around a pivotal point, and an adjusting operation in the trim angle of the respective propeller around the pivotal point to adjust the direction of the propelling force, said plurality of switches being disposed in only a lever grip of one of the control levers such that said plurality of tilt and trim switches and said plural control levers can be simultaneously operated by using a single hand.

* * * * *